United States Patent [19]

Kuczenski

[11] 4,404,933

[45] Sep. 20, 1983

[54] SELF-MOUNTING PNEUMATIC FUEL PRIMER

[75] Inventor: Steven R. Kuczenski, New Holstein, Wis.

[73] Assignee: Tecumseh Products Company, Tecumseh, Mich.

[21] Appl. No.: 297,994

[22] Filed: Aug. 31, 1981

[51] Int. Cl.[3] ..... F02M 1/16

[52] U.S. Cl. ..... 123/187.5 R; 123/187.5 P; 24/213 R; 220/315

[58] Field of Search ..... 123/187.5 R, 187.5 P; 24/213 R, 213 CS, 214; 220/307, 315

[56] References Cited

U.S. PATENT DOCUMENTS

| | | | |
|---|---|---|---|
| 2,397,801 | 4/1946 | Mitchell | 24/213 R |
| 2,590,264 | 3/1952 | Meyers et al. | 24/213 R |
| 3,089,269 | 5/1963 | McKiernan | 24/213 CS |
| 3,181,411 | 5/1965 | Mejlso . | |
| 3,275,305 | 9/1966 | Nutten | 123/187.5 R |
| 3,451,383 | 6/1969 | Nelson | 123/187.5 R |
| 4,004,734 | 1/1977 | Hadtke | 220/315 |

FOREIGN PATENT DOCUMENTS

| | | | |
|---|---|---|---|
| 475556 | 11/1937 | United Kingdom | 24/214 |

OTHER PUBLICATIONS

"4–Stroke Cycle Engine," Lawson, Mechanics Handbook, pp. 2-2-6 Jan. 19, 1977, Tecumseh Products Company, Grafton, Wisconsin.

*Primary Examiner*—Parshotam S. Lall
*Attorney, Agent, or Firm*—Albert L. Jeffers

[57] ABSTRACT

A two-piece self-fastening primer bulb structure for an internal combustion engine has a bulb of relatively flexible material with an annular mounting ring at a lower extremity thereof along with a base of relatively more stiff resilient material having a slotted rim for sealingly receiving the bulb mounting ring. The base is provided with a pair of self-fastening protuberances to be forced into an apertured support such as an engine housing or other panel deforming as they pass therethrough and reexpanding to secure the base to the support.

14 Claims, 3 Drawing Figures

SELF-MOUNTING PNEUMATIC FUEL PRIMER

A primer for introducing a charge of fuel into an internal combustion engine intake system for starting that engine is disclosed comprising two simplistic plastic parts readily assemblable and easily mountable on a support such as an engine housing or other panel associated with an engine powered implement. The primer has a primer bulb of relatively flexible resilient material having an annular mounting ring in the shape generally of an O-ring at a lower extremity thereof along with a base of relatively more stiff resilient material having a slotted rim or retainer groove which sealingly receives the bulb mounting ring which base also has a pair of self-fastening protuberances which are simply forced into an apertured support deforming as they pass therethrough and reexpanding to secure the base to the support.

The present invention relates generally to pneumatic primers and ,more particularly to a two piece fuel primer of self mounting design.

In small internal combustion engines particularly those engines which are hand cranked for starting it is frequently desirable to provide some scheme for introducing a fuel charge into the engine intake system to make the engine start more easily. Such a priming arrangement is particularly desirable where such engines are used in cold weather environments such as snowthrowers and the like. Numerous priming systems have been marketed or illustrated in the patent literature.

The known priming arrangements are typically in the form of an operator actuable priming bulb which when depressed displaces a volume of air into a carburator float bowl or fuel well with that air in turn displacing fuel from the carburetor into the engine intake system. Such an arrangement is illustrated for example in U.S. Pat. Nos. 4,197,825 and 4,203,405. While in these particular patents fuel is displaced from well in the carburetor, other known systems displace fuel from the float bowl or actuate a diaphragm in a diaphragm type carburetor to achieve the priming function and the present invention is not limited to a particular type of priming operation.

In one known priming bulb construction, a base member has a slot opening radially outwardly to receive a corresponding radially inwardly extending lip of a pliable primer bulb or bellows. The base has an apertured threaded nozzle for receiving a mounting nut and an air hose for connection to a carburetor. A cup-like retainer is employed to hold the lip of the primer bulb in the base slot. Thus, in assembling this known primer bulb arrangement, the lip of the bulb is first placed in the base slot, then the cup is placed over the bulb to hold it securely in the base slot, and thereafter the threaded portion of the base is passed through a support such as the engine housing or other panel and fastening thereto by the nut, and thereafter the air hose connected to the base. In addition to the air hose, this known construction employs four parts and is relatively time consuming to assemble.

Among the several objects of the present invention may be noted the provision of a manually actuable priming structure which is easily and quickly mounted to a support; the elimination of half the parts from the abovementioned primer bulb construction and the reduction in the assembly time associated therewith; the provision of an improved sealing system between a primer bulb and ite associated base; the provision of a primer arrangement constructed entirely of non-metallic parts; and the provision of a simplistic and economical priming arrangement. These as well as other objects and advantageous features of the present invention will be in part apparent and in part pointed out hereinafter.

In general, a primer arrangement for introducing fuel preparatory to starting an engine includes a primer bulb of relatively flexible material with an annular mounting ring at an extremity thereof and a base of relatively stiff resilient material having a slotted rim for sealingly receiving the annular mounting ring and having a self-fastening arrangement which may be inserted into an apertured support to secure the base to that support.

Also in general and in one form of the invention a primer includes a primer bulb with an annular mounting ring portion and base of relatively stiff resilient material with a slotted rim for receiving the annular mounting ring with the mounting ring having a cross-sectional width somewhat greater than the corresponding width of the rim slot so that when the bulb is assembled to the base, material of the mounting ring is deformed to tightly sealingly engage and substantially fill the slotted rim with the natural interengagement of the mounting ring and rim slot forming the sole interconnection between the bulb and the base.

Corresponding parts are identified by like reference numerals throughout the several views of the drawing.

Figure 1:
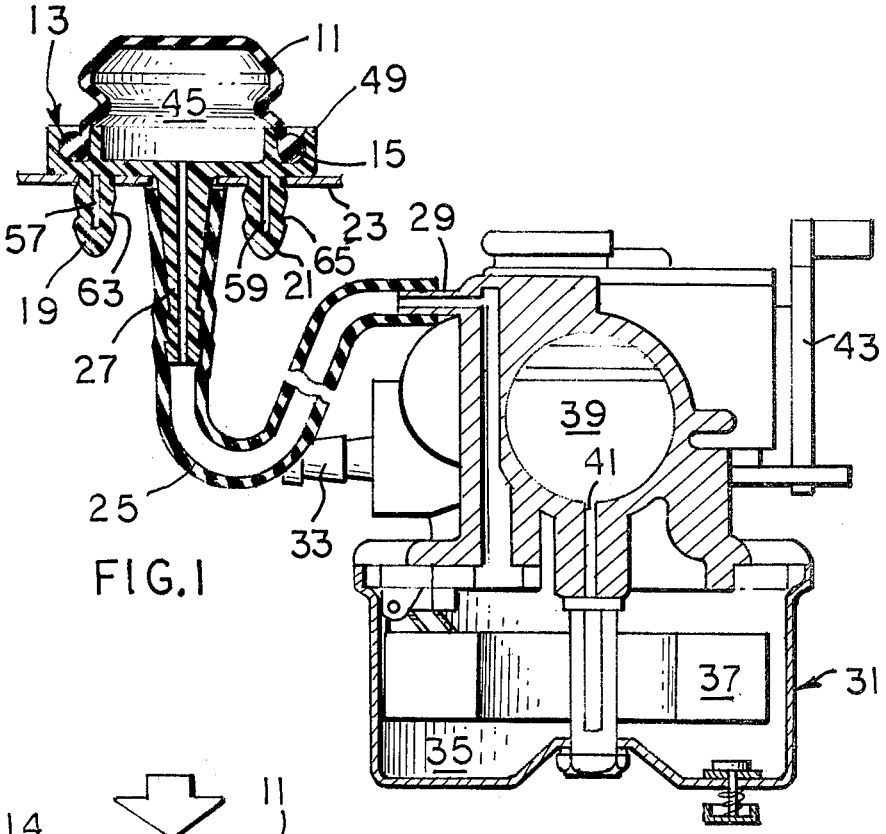
FIG. 1 is a view in cross-section of an illustrative carburetion system employing the fuel primer of the present invention.

The exemplifications set out herein illustrate a preferred embodiment of the invention in one form thereof and such exemplifications are not to be construed as limiting the scope of the disclosure or the scope of the invention in any manner.

Referring to the drawing generally, an improved seal between the resilient primer bulb 11 and the base 13 is achieved and the assembly time of the priming arrangement is substantially reduced by providing the primer bulb or bellows 11 with an O-ring or annular mounting ring 15 which may be pressed into the retaining groove 17 with bulb mounting ring material deformed to tightly sealingly engage the slotted rim 17. The base member 13 is provided with two fasteners 19 and 21 which may be forced through apertures in a support 23 such as a sheet metal or fiberglass engine blower housing or similar panel to hold the primer arrangement in position. The fasteners 19 and 21 are slotted or corrugated to deform readily and pass through the apertures and may for example be constructed in a manner similar to the fasteners illustrated in U.S. Pat. 3,181,411. After mounting the priming bulb, a tube or air hose 25 is slipped over the barbed nozzle 27 with the other end of the hose connected to an air priming inlet 29 of a small engine carburetor 31. Assembly of the primer arrangement is thus simply a snapping together of the bulb and base followed by a snapping of the base into its support and attachment of the hose 25. Primer bulb 11 is formed of a relatively flexible resilient material such as an E.P.T. compound or other suitable rubber-like material while base 13 may be formed of a relatively more stiff resilient material such as Zytel No. 101, Nylon or other plastic material.

In FIG. 1, there is illustrated one type carburetor in which the present priming system finds utility. Fuel is supplied to the carburetor 31 through inlet 33 and partially fills float bowl 35 to a level determined by an inlet valve under the control of float 37. During normal engine operation, air passing through the throat 39 of carburetor 31 sucks some of this fuel into the air intake stream by way of nozzle 41. Bore 39 may be provided with choke and throttle butterfly valves with the throttle valve controlled by linkage 43 in a conventional manner. When the engine is inoperative, a preparatory fuel charge may be introduced into the bore 39 by depressing primer bulb 11, displacing air from the interior region 45, and by way of air hose 25, into the region above the fuel in float bowl 35. This displaced air in turn forces fuel from the float bowl by way of nozzle 41 into the engine intake system providing the desired priming charge of fuel for starting the engine.

Figure 2:
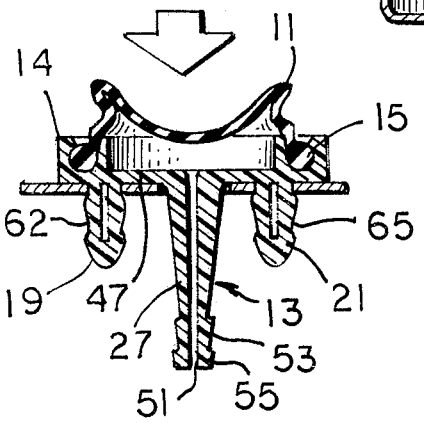
FIG. 2 is a cross-sectional view of the fuel primer of FIG. 1 with the bulb depressed to displace air during a priming operation.
Figure 3:
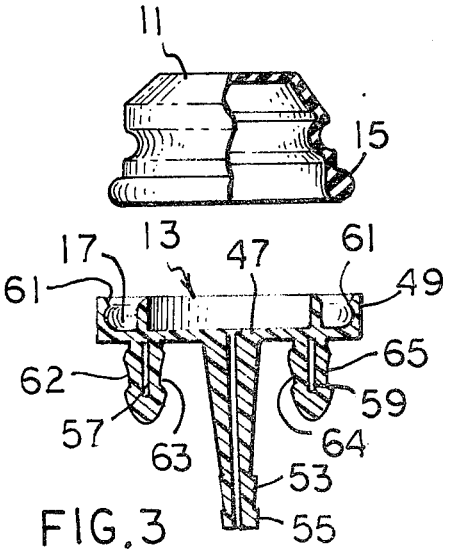
FIG. 3 is an exploded partial section view of the fuel primer of FIGS. 1 and 2.

The base of the two piece self-mounting primer has a generally planar portion 47 with an annular slotted rim 49 extending therefrom in one direction and with the self-fastening protuberances 19 and 21 as well as the hose attachment 27 extending therefrom in the opposite direction. The fastening protuberances 19 and 21 extend generally parallel to the hose attachment 27. The slotted rim and planar portion 47 together form a cup-like depression and it will be noted in FIG. 2 that the primer bulb 11 when depressed or actuated may extend into this cup-like depression.

Hose connection 27 is an apertured protuberance with the aperture or hole 51 conveying displaced air from region 45 to hose 25. This protuberance is generally cylindrical and includes a plurality of annular stepped tapers 53 and 55 appearing as a generally saw-toothed configuration in cross-section and functioning as barbs to retain the hose in position once the protuberance 27 is passed into the hose.

Fasteners 19 and 21 are slotted or corrugated as at 57 and 59 so that these fasteners compress particularly in a horizontal direction in the plane depicted in the drawing as they are simultaneously inserted into a pair of holes in the support 23 and as the fasteners extend beyond the opposite side of that support they reexpand to secure base 13 to the support 23.

To illustrate the sealing interference fit between the bulb and base, the width of slot 17 may for example be 0.167 inches while the corresponding thickness of the annular mounting ring 15 may be 0.180 inches. Under these circumstances when the ring is forced into the slot, excess material flows toward the lower inside corner of the slot 17 with a resulting permanent deformation of the ring and good sealing engagement between the ring and base. An overlying lip 61 may be provided in slot 17 to help secure ring 15 therein. Thus, the natural interengagement of the mounting ring and rim slot with the ring substantially filling the slot, as in FIGS. 1 and 2, forms the sole interconnection between the bulb 11 and base 13.

The fasteners or protuberances 19 and 21 include additional side wall indentations at 62, 63, 64 and 65. These allow the primer to be preassembled to a mounting panel with the fasteners extending through that panel only part way to rest at the indentations during, for example, the time the primer and panel are in a paint oven. This eliminates problems of the fastener taking a set during such a heating process. The primer fasteners are forced further into the panel subsequent to such paint oven processing.

From the foregoing it is now apparent that a novel two piece seld-mounting manually actuable primer has been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

I claim;

1. A two piece self-mounting manually actuable primer for introducing a priming charge of fuel into an internal combustion engine intake system preparatory to starting the engine comprising:
   - a primer bulb or relatively flexible resilient material with an annular mounting ring at an extremity thereof; and
   - a base of relatively stiff resilient material having a slotted rim for sealingly receiving the annular mounting ring, a pair of self-fastening protuberances for passing into an apertured support to secure the base to the support and an apertured air passing protuberance with the protuberances all extending from a common base surface generally parallel to one another.

2. The primer of claim 1 wherein each self-fastening protuberance comprises an elongated shank corrugated in cross-section and extending from the base to be compressed, passed into a support aperture and reexpanded to grip the support.

3. The primer of claim 1 wherein each self-fastening protuberance comprises an elongated slotted shank to be compressed, the protuberances passed simultaneously into a corresponding pair of support apertures, and each re-expanding to grip the support.

4. The primer of claim 1 wherein the apertured protuberance so generally cylindrical and includes a plurality of annular stepped tapers on the exterior surface thereof to be passed into and secure one end of an air hose thereabout 5. The primer of claim 1 wherein the base includes a generally planar portion having the slotted rim extending therefrom in one direction and the self-fastening protuberance extending therefrom in an opposite direction.

6. The primer of claim 5 wherein the slotted rim and planar portion form a cup-like depression into which the primer bulb may extend when actuated.

7. The primer of claim 1 wherein the mounting ring has a cross-sectional width somewhat greater than the corresponding width of the rim slot so that when the bulb is assembled to the base, bulb mounting ring material is deformed to tightly sealingly engage the slotted rim.

8. The primer of claim 7 wherein the natural interengagement of the mounting ring and the rim slot with the ring substantially filling the slot forms the sole interconnection between the bulb and the base.

9. A two piece manually actuable primer for introducing a priming charge of fuel into an internal combustion engine intake system preparatory to starting the engine comprising:
   - a primer bulb of relatively flexible resilient material with an annular mounting ring at an extremity thereof,
   - a base of relatively stiff resilient material having a slotted rim for receiving the annular mounting ring, and a pair of self-fastening protuberances extending from the base generally parallel to one another and each comprising an elongated shank corrugated in cross section to be compressed, simultaneously pressed into a correspondingly apertured support and reexpanded to securely grip the support apertures fastening the base to the support;

the mounting ring having a cross-sectional width somewhat greater than the corresponding width of the rim slot so that when the bulb is assembled to the base, bulb mounting ring material is deformed to tightly sealingly engage and substantially fill the slotted rim with the natural interengagement of the mounting ring and the rim slot forming the sole interconnection between the bulb and the base.

10. The primer of claim 9 wherein the base includes an apertured hose connection for coupling the primer by way of an air hose to a carburetor, the connection extending intermediate and generally parallel to the self-fastening protuberances for passing air displaced when the bulb is manually actuated from the primer toward the carburetor.

11. The primer of claim 10 wherein the hose connection is generally cylindrical and includes an annular barb for receiving and retaining a flexible air hose thereabout.

12. The primer of claim 9 wherein the rim slot includes a lip protruding into the slot to restrict removal of the mounting ring from the slot.

13. The primer of claim 9 wherein the protuberances include intermediate indentations for engaging the apertured support to temporarily fasten the base to the support during assembly.

14. A two piece self-mounting manually actuable primer for introducing a priming charge of fuel into an internal combustion engine intake system preparatory to starting the engine comprising:

a primer bulb of relatively flexible resilient material with an annular mounting ring at an extremity thereof; and a base of relatively stiff resilient material having a slotted rim for sealingly receiving the annular mounting ring and having a self-fastening protuberance for passing into an apertured support to secure the base to the support, the protuberance including at least one intermediate indentation for engaging the apertured support to temporarily fasten the base to the support during assembly.

* * * * *